US006412602B1

(12) United States Patent
Sundman

(10) Patent No.: US 6,412,602 B1
(45) Date of Patent: Jul. 2, 2002

(54) CLIMBING DEVICE

(75) Inventor: Peter Sundman, Vallda (SE)

(73) Assignee: Act Safe Systems AB, Uddevalla (SE)

( * ) Notice: Subject to any disclaimer, the term of this patent is extended or adjusted under 35 U.S.C. 154(b) by 0 days.

(21) Appl. No.: 09/530,911

(22) PCT Filed: Nov. 6, 1998

(86) PCT No.: PCT/SE98/02008

§ 371 (c)(1),
(2), (4) Date: Jun. 14, 2000

(87) PCT Pub. No.: WO99/24122

PCT Pub. Date: May 20, 1999

(30) Foreign Application Priority Data

Nov. 6, 1997 (SE) ..... 9704059

(51) Int. Cl.[7] ..... A63B 27/00; B66D 3/04

(52) U.S. Cl. ..... 182/133; 254/390

(58) Field of Search ..... 182/191, 192, 182/193, 235, 5, 71, 72; 188/65.2; 254/372, 389, 390, 391, 222, 226; 220/188, 193; 74/89.22

(56) References Cited

U.S. PATENT DOCUMENTS

| | | | | | |
|---|---|---|---|---|---|
| 296,298 | A | * | 4/1884 | Sherman | 182/193 X |
| 2,569,597 | A | * | 10/1951 | Bailey, Sr. | 182/235 |
| 2,931,466 | A | | 4/1960 | Allenbaugh | |
| 3,276,745 | A | | 10/1966 | Mauldin | |
| RE28,273 | E | * | 12/1974 | Brda | 182/193 X |
| 4,003,550 | A | * | 1/1977 | Brodin | 182/192 X |
| 4,145,027 | A | * | 3/1979 | Brimo | 188/65.2 X |
| 4,941,548 | A | * | 7/1990 | Blanchard | 182/5 X |
| 5,638,919 | A | * | 6/1997 | Pejout | 182/192 |
| 5,927,438 | A | * | 7/1999 | Ostrobrod | 182/5 X |

FOREIGN PATENT DOCUMENTS

| | | | | |
|---|---|---|---|---|
| DE | 46891 | * | 3/1982 | 182/235 |
| DE | 2554102 | * | 5/1985 | 182/5 X |
| FR | 2599630 | * | 12/1987 | 182/5 |
| FR | 2626184 | * | 7/1989 | 182/5 |

* cited by examiner

*Primary Examiner*—Daniel P. Stodola
*Assistant Examiner*—Hugh B. Thompson
(74) *Attorney, Agent, or Firm*—Nixon & Vanderhye

(57) ABSTRACT

The invention relates to a motor-driven (22) climbing device (1) which, with the aid of a motor-driven winch (14) and a conventional rope lock (4), allows comfortable ascent along a rope (2), the safety factor with regard to fall prevention being maintained.

19 Claims, 2 Drawing Sheets

CLIMBING DEVICE

Figure 2:
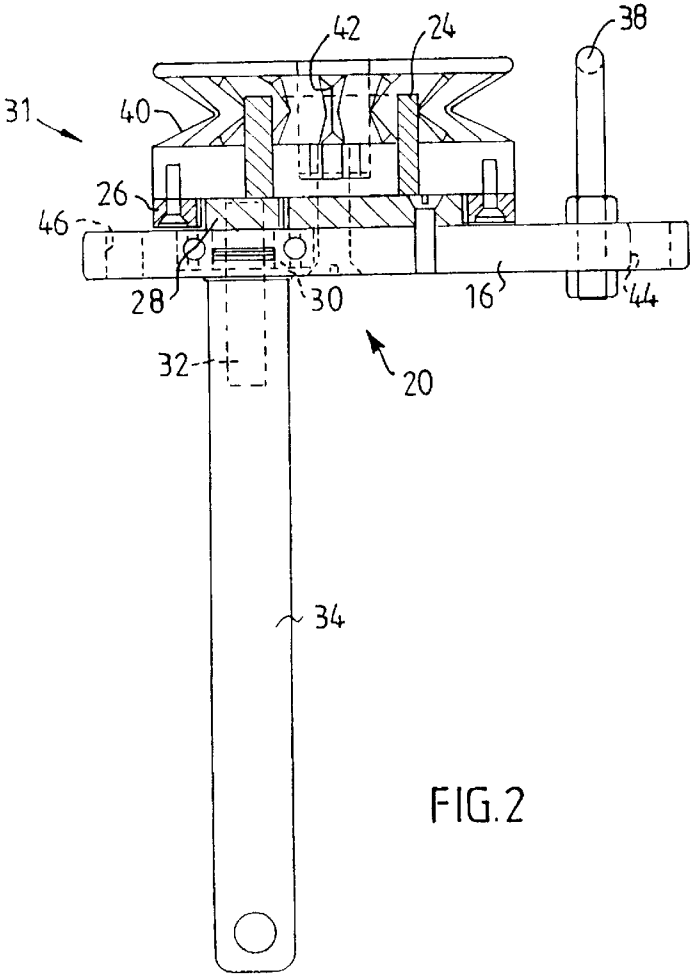

The invention relates to a climbing device comprising a rope anchored by one of its ends to a support and at least one first engagement arrangement which can be locked securely on the rope in such a manner that the device is displaceable in the direction towards the anchored end of the rope under the action of a climbing force and in locking engagement with the rope when the climbing force stops.

Devices of this type are used together with safety harnesses especially as personal fall-prevention equipment during climbing of all types, whether mountain climbing or climbing associated with buildings or structures of various types, for example for generating hydroelectric power, and in inter alia the performance of maintenance and rescue work. In the latter type of work, the load usually comprises at least one person as well as the equipment necessary for the work, which may be heavy to lift by means of muscular strength alone.

Horizontal movement of a load, for example a person, may also come into consideration in those situations where it is necessary for the load to be continuously secured in an optional position between an initial position and a final position. Examples of situations in which such horizontal load movement may be relevant are where violent storms (hurricanes etc.) advance across land and sea.

For various reasons, it may sometimes be advantageous to be able to "winch home" a load or a person in distress by means of a winch, which is carried out, for example in the case of a helicopter rescue, by means of a winch mounted in the helicopter, which is operated by a winchman. A surface rescuer is winched down to the person in distress by the winchman who then winches up both the person in distress and the surface rescuer separately or together. This is demanding in terms of both personnel and resources but of course well-justified for the purpose of saving life.

For certain purposes, it is advantageous or even a vital necessity to be able to maintain the same high level of safety in simpler situations which are less demanding in terms of personnel and resources. For example, during the maintenance of turbines of hydroelectric power stations, a maintenance person is usually winched down by a winchman through a manhole to ducts and spaces which are filled with water during operation, can be kept free of water for maintenance work only for relatively short periods of time by means of hatches that are not completely leakproof, and are shielded from radio waves. On account of the risk of water penetration and also the restricted access to air, the maintenance person must therefore as a rule carry with him oxygen equipment, and communication must be maintained by signs, loud shouts or via a wire or cable link. This is because, when the water level begins to become alarmingly high, the maintenance person is dependent upon the attentiveness of the winchman for being winched up.

The object of the invention is therefore to provide an improved climbing device of the type indicated in the introduction, which allows winching-home according to established safety margins (on the initiative of the maintenance person) to be performed in a simpler, more reliable and more efficient manner than previously, independently of communication systems and without the assistance of a separate winchman.

According to the invention, this is achieved by virtue of the fact that the device is equipped with at least one drivable second engagement arrangement which is arranged so as to act on the free end of the rope between the locking engagement of the first engagement arrangement with the rope and a load connected to the device, for example a user equipped with a safety harness, in order to produce the climbing force and move the locking engagement towards the anchored end of the rope.

Further features and advantageous developments and improvements of the invention emerge from the measures indicated in the dependent patent claims.

Figure 1:
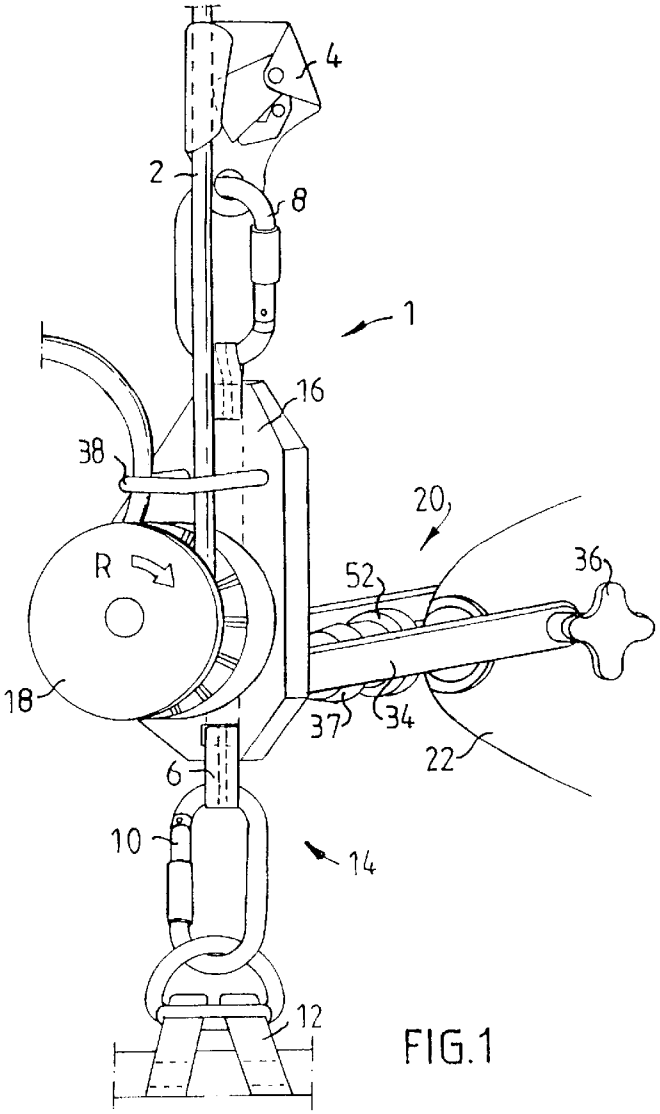
Figure 3:
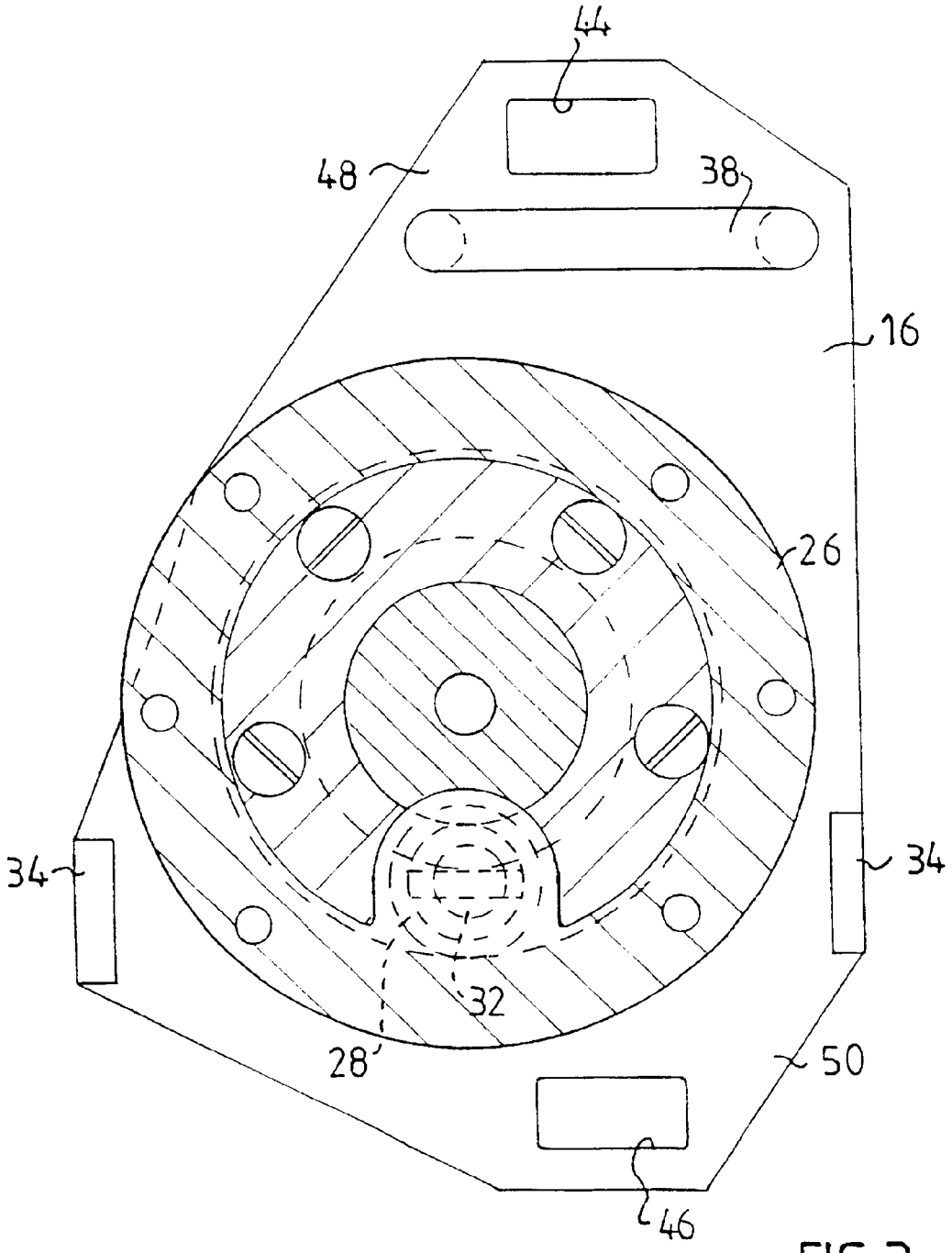

A preferred embodiment of the invention is described in greater detail in the description below solely by way of example with reference to the appended diagrammatic drawing, in which FIG. 1 shows a perspective view of a climbing device according to the invention, FIG. 2 shows a vertical view of a winch for the climbing device with a rope pulley mounted on a transmission plate and a motor attachment projecting on the opposite side, and FIG. 3 shows the transmission plate in FIG. 2 in a horizontal view seen from the side of the rope pulley.

In FIG. 1, the climbing device is designated generally by reference number 1 and comprises a rope 2 anchored by one of its ends to a support and a first engagement arrangement in the form of a rope lock 4 of a type known per se. A suspension link 6 in the form of a standard sling is, by means of associated coupling components 8 and 10, connected at one end to the rope lock 4 and at the other end to a safety harness 12 worn by a user. All these components are of a type approved for the purpose and have been inspected in the stipulated manner and provided with the so-called CE mark. These components are consequently those that are available as aids for conventional climbing.

A considerable improvement of the characteristics of the device can be achieved by providing a drivable second engagement arrangement in the form of a winch 14. The winch consists of a transmission plate 16 which supports in a rotatable manner a rope pulley 18 which can be rotated by a drive arrangement 20 by means of a motor 22, for example an internal combustion motor-driven drilling machine known per se or an electric motor which may be battery-operated or driven from the mains, a power plant or the like.

On one side of the transmission plate 16, the rope pulley 18 is rotatably mounted by means of a slide bearing 24, and an internally toothed gear ring 26 is fastened on its side facing the plate 16. An externally toothed pinion 28 is in engagement with the gear ring and is mounted in a ball bearing 30 which is mounted in a recess in the plate 16. Together with the gear ring, the pinion 28 forms a reduction gear 31 and has a shaft spindle 32 which projects from the opposite side of the plate and is intended to be connected to the motor 22. On the same side of the plate, two projecting fastening arms constitute a motor attachment 34, into which the motor 22 can be introduced and screwed firmly by means of fastening screws 36.

According to the embodiment shown, the motor is constituted by the abovementioned drilling machine which is connected to the winch 14 via a chuck 37 which belongs to the machine and can be locked on the spindle 32. Tests have shown that a power of 1.2 hp is sufficient to lift a load of around 200 kg at a ratio of 3.3:1 in the reduction gear.

The transmission plate 16 also has members for guiding the rope in the form of a shackle 38 which is anchored in the plate on its end portion facing the rope lock 4. By means of the shackle, both the incoming and the outgoing strands of the rope are made to run to and from, respectively, a V-shaped groove 40 formed in the cylindrical outer surface of the rope pulley 18. On both its flanks, the groove has radially oriented bars 42 which are distributed with uniform spacing along the circumference of the groove.

The shackle 38 ensures that the angle of engagement of the rope with the groove is essentially 180 degrees, which provides advantageous friction between the rope and the pulley, which results in secure engagement.

According to an embodiment that is not shown, the bars 42 are instead oriented in the groove 40 at an oblique angle relative to the radius of the pulley 18. Each bar is in this way shifted, with its end located at the periphery of the groove, an optional distance in the direction of rotation of the pulley in comparison with that end of the bar which merges with the bottom of the groove. This embodiment of the bars results in a stronger self-locking effect than in the case of radial bars. Both these variants of the rope pulley are previously known per se and are commonly found in sheet and halyard winches on sailing boats under the name cabular sheave.

As emerges from the figures, the transmission plate 16 is provided with a first and a second suspension opening 44 and 46, respectively, with rounded edges associated with each of two mutually opposite portions of the plate, that is to say a first portion 48 and a second portion 50. By virtue of the fact that the suspension link according to the embodiment shown consists of a flexible standard sling 6, it is possible, as can be seen best from FIG. 1, to allow the sling 6 to run through the suspension openings 44 and 46 without the strength of the sling being affected. In this way, a climbing device in the form of a coherent unit is obtained, which makes handling easier, during both transport and use of the device.

According to a further embodiment (not shown), the sling 6 has been incorporated into a piece of rigid fibreglass-reinforced plastic, as a result of which it is possible to allow the suspension link/the sling 6 to run between the rope lock 4 and the safety harness 12 entirely separately from and independently of the plate 16. The plate is then instead connected to the safety harness via, for example, an extra coupling component 10.

According to the embodiment shown, a conventional one-way coupling 52 is coupled between the output shaft (not shown) of the motor 22 and the input shaft 32 of the reduction gear 31. In this way, the pulley 18 is freely rotatable relative to the motor in only the indicated direction of rotation R while the pulley is locked against rotation in the opposite direction.

In order to prevent mutual jamming of the incoming and outgoing strands of the rope 2 in the groove 40 of the pulley 18, it is advantageous to arrange a separation blade (not shown) between the legs of the shackle 38 that guides the rope. The blade may be in the form of a suitably bent flat iron piece or the like and it separates the strands of the rope so that they do not come into contact with one another as they run through the shackle 38.

The functioning of the climbing device is explained below with reference to FIG. 1. The rope lock 4 is initially in engagement with the rope 2 and then supports the weight of both the user and the device via the suspension link 6. Below the rope lock, the rope is wound around the rope pulley 18 and in engagement with the bars 42 on the flanks of the groove 40 and runs through the shackle 38 that guides the rope. All the user then needs to do is to start the motor 22 and, by varying the speed of the motor, determine how rapidly the ascent is to take place. By virtue of the fact that the rope pulley strives to "winch home" the rope, the pulley will "climb" up after the rope. During this movement, the rope lock 4 is released and is pushed in front of the winch 14, but as soon as the user stops the output shaft of the motor 22, the rope lock will once again be actuated to engage with the rope in accordance with the principle of the rope lock.

Fall prevention is therefore ensured as the rope lock 4 can always act on the rope above the engagement of the rope pulley 18 with the rope. A climbing device has thus been produced, which has the same high safety factor for fall prevention as a conventional device of the CE-marked type, but which is considerably more comfortable and allows longer ascents in a shorter time than previously on the conditions of the user. All things considered, the user can therefore perform improved work and knows with certainty that he can start his ascent at short notice and without any physical exertion as far as climbing force is concerned.

What is claimed is:

1. A climbing device comprising:

a rope for anchoring at one end to a support, at least one first engagement arrangement releasably locked to the rope, said first engagement arrangement being displaceable in a direction towards the anchored end of the rope under the action of a climbing force and in locking engagement with the rope when the climbing force stops;

at least one drivable second engagement arrangement disposed to act on a free end of the rope, said second engagement arrangement being located between the locking engagement of the first engagement arrangement with the rope and a load carried by the rope to produce the climbing force and move the first engagement arrangement along the rope and towards the anchored end of the rope;

a suspension link connected adjacent one end to the first engagement arrangement and at an opposite end to the load; and said second engagement arrangement including a transmission plate, a rotatable rope pulley carried by said plate, a drive arrangement carried by said plate for rotating the pulley, and a motor attachment for connecting a motor to the drive arrangement.

2. The device according to claim 1 wherein the plate has a first portion which faces the anchored end of the rope and includes members for guiding the rope, said members being arranged so as to guide both incoming and outgoing strands of the rope relative to the pulley to establish an angle of an engagement of the rope strands with the pulley.

3. The device according to claim 2 wherein the members for guiding the rope form shackles carried by said plate and through which shackles the strands of the rope are arranged to run.

4. The device according to claim 2 including a separation blade adjacent two said members and arranged between the incoming and outgoing strands of the rope to prevent mutual jamming of the strands in the groove of the rope pulley.

5. The device according to claim 1 wherein the motor attachment comprises fastening arms which project from the plate and between which the motor can be screwed firmly.

6. The device according to claim 1 wherein the drive arrangement comprises a reduction gear connected between the motor and the pulley and by means of which the speed of the pulley is reduced relative to the speed of the motor.

7. The device according to claim 6 including a one-way coupling arranged between an output shaft of the motor and an input shaft of the reduction gear such that the pulley is freely rotatable relative to the motor in only a predetermined direction of rotation.

8. The device according to claim 6 wherein the reduction gear has at least one transmission part integrated in the pulley.

9. The device according to claim 1 wherein the pulley has a circumferentially extending groove of V-shaped cross-section.

10. The device of claim 9 wherein the pulley has two flanks on opposite sides of the groove, each of the flanks having bars distributed with uniform spacing along the circumference of the groove.

11. The device according to claim 10 wherein the bars are radially oriented in the groove.

12. The device according to claim 10 wherein the bars are oriented in the groove at an oblique angle relative to the radius of the pulley.

13. The device according to claim 1 including at least one suspension opening with rounded edges formed in the plate for suspending the same on the suspension link.

14. The device according to claim 13 wherein the plate has first and second suspension openings associated with each of two opposite portions of the plate, respectively.

15. The device according to claim 1 wherein the pulley comprises a sheave.

16. The device according to claim 6 wherein the motor consists of an internal combustion motor-driven drilling machine connected to an input shaft of a one-way coupling by means of a chuck.

17. The device according to claim 1 wherein said motor comprises an electric motor.

18. The device according to claim 1 wherein the suspension link is flexible.

19. The device according to claim 1 wherein the suspension link is rigid and runs independently of and separately from said plate.

* * * * *